US005946538A

United States Patent [19]

Takeuchi et al.

[11] Patent Number: 5,946,538

[45] Date of Patent: Aug. 31, 1999

[54] IMAGE FORMING APPARATUS

[75] Inventors: Akihiko Takeuchi, Susono; Tatsuya Kobayashi, Sohka; Toshiaki Miyashiro, Shizuoka-ken; Naoki Enomoto, Susono; Takaaki Tsuruya, Mishima; Kazuhiro Funatani, Numazu, all of Japan

[73] Assignee: Canon Kabushiki Kaisha, Tokyo, Japan

[21] Appl. No.: 08/960,737

[22] Filed: Oct. 30, 1997

[30] Foreign Application Priority Data

Nov. 1, 1996 [JP] Japan ..... 8-292160
Oct. 17, 1997 [JP] Japan ..... 9-285206

[51] Int. Cl.[6] ..... G03G 15/14

[52] U.S. Cl. ..... 399/302; 399/308; 399/344

[58] Field of Search ..... 399/302, 308, 399/343, 344, 298

[56] References Cited

U.S. PATENT DOCUMENTS

| | | | |
|---|---|---|---|
| 5,243,392 | 9/1993 | Berkes et al. | 355/275 |
| 5,253,022 | 10/1993 | Takeuchi et al. | 355/274 |
| 5,402,218 | 3/1995 | Miyashiro et al. | 355/274 |
| 5,438,398 | 8/1995 | Tanigawa et al. . | |
| 5,600,420 | 2/1997 | Saito et al. | 399/302 |
| 5,608,505 | 3/1997 | Takeuchi et al. | 399/314 |
| 5,669,052 | 9/1997 | Kusaba et al. | 399/308 |

*Primary Examiner*—R. L. Moses
*Attorney, Agent, or Firm*—Fitzpatrick, Cella, Harper & Scinto

[57] ABSTRACT

An image forming apparatus includes an image bearing member for carrying toner images of different colors; a rotatable intermediary transfer member to which the toner images are superimposedly transferred from said image bearing member onto said intermediary transfer member at a first transfer position, wherein the toner images are then transferred all together from said intermediary transfer member onto the transfer material at a second transfer position; wherein said intermediary transfer member includes an elastic layer having a thickness of 0.5–2 (mm), a coating layer, on said elastic layer, having a volume resistivity which is larger than that of said elastic layer, and said intermediary transfer member satisfies:

$$T \leqq \tau \leqq 500 \text{ (sec)}$$

where $\tau$ (sec) is time required for a potential V of said intermediary transfer member at one second after a surface of said intermediary transfer member charged to a predetermined potential rotates at a rotational speed of 10 (cm/s) to become V/e (e: base of natural logarithm, e=2.71828 . . . ); and T (sec) is a rotation period of said intermediary transfer member when the toner images on said image bearing member are sequentially and superimposedly transferred onto said intermediary transfer member at the first transfer position.

14 Claims, 11 Drawing Sheets

| τ (SEC) | < 1 | 2 | 5 | 50 | 500 | >1000 |
|---|---|---|---|---|---|---|
| LINE WASH-OUT | NG | NG | F | G | G | G |
| 2RY TRANSFER PERFORMANCE | G | G | G | G | F | NG |

NG --- NO GOOD
F --- FAIR (PRACTICAL)
G --- GOOD

FIG. 12

| THICHNSS (μm) | 1 | 2 | 5 | 20 | 50 | 80 | 100 |
|---|---|---|---|---|---|---|---|
| τ (SEC)<br>Vo (V) | 2<br><100 | 5<br>200 | 8<br>350 | 10<br>400 | 50<br>430 | 70<br>440 | 100<br>450 |
| LINE WASH-OUT | NG | F | G | G | G | G | G |
| 2RY TRANSFER PERFORMANCE | G | G | G | G | G | F | NG |

NG --- NO GOOD
F --- FAIR (PRACTICAL)
G --- GOOD

FIG. 13

($\tau$ = 10000 sec)

| RELATIVE SPEED (%) | -3 | -2 | -1.5 | -1 | -0.5 | 0 | +0.5 | +1 | +1.5 | +2 | +3 |
|---|---|---|---|---|---|---|---|---|---|---|---|
| LINE WASH-OUT | G | G | G | G | G | G | G | G | G | G | G |
| 2RY TRANSFER PERFORMANCE | G | G | G | G | F | NG | F | G | G | G | G |
| COLOR MISREGISTRATION PITCH NON-UNIFORMITY | NG | NG | F | G | G | G | G | G | G | F | NG |

NG --- NO GOOD
F --- FAIR (PRACTICAL)
G --- GOOD

IMAGE FORMING APPARATUS

FIELD OF THE INVENTION AND RELATED ART

The present invention relates to an image forming apparatus wherein a toner image formed on an image bearing member is transferred onto an intermediary transfer member, which in turn is transferred onto a transfer material.

Conventionally, in an image forming apparatus of an electrophotographic type, an intermediary transfer member is provided in addition to a photosensitive drum as an image bearing member. In such an apparatus, the primary transfer operation of transferring a toner image formed on the image bearing member onto an intermediary transfer member, is repeated to superimpose the toner images on the intermediary transfer member, and then, the toner images are transferred all together onto a transfer material(secondary transfer).

FIG. 11 shows an example of an image forming apparatus using the intermediary transfer member.

The image forming apparatus shown in this Figure is provided with a photosensitive drum 101 as the image bearing member. Around the photosensitive drum 101 supported for rotation in the direction of an arrow R1, four developing devices 105, 106, 107, 108 containing black (BK), magenta (M), cyan (C) and yellow (M) toner materials. Among the developing devices, the one operated for the development of the electrostatic latent image on the photosensitive drum 101 is brought into contact to the photosensitive drum 101 by toward and away from means (unshown).

The photosensitive drum 101 is charged uniformly by a charger 102, and is exposed to a scanning light(laser beam) 104 through a laser exposure optical system 103 or the like so that electrostatic latent image is formed. The electrostatic latent image is developed by the developing device 105 or the like into a toner image, and is transferred (primary transfer) onto the intermediary transfer belt 109 (intermediary transfer member) sequentially by a primary transfer roller 110. The development of the electrostatic latent image, the development thereof and the primary transfer thereof is carried out for the four color toner materials by the developing devices 105–108 or the like sequentially, by which superimposed color toner image is formed on the intermediary transfer belt 109. Then, the toner image is transferred (secondary transfer) all together onto the transfer material 118 fed by a secondary transfer roller 111 and an intermediary transfer belt 109.

The primary transfer and the secondary transfer will be further described. When the photosensitive drum 101 is an OPC (organic photoconductor) photosensitive member having a negative charging property, for example, negative property toner is used in the development by the developing devices 105–108 to deposit the toner to the exposure portion (laser beam 104). Therefore, the primary transfer roller 110 is supplied with a transfer bias voltage by a bias voltage source 120. Here, the intermediary transfer belt 109 is normally an endless resin film of PVdF (polyvinylidene fluoride), Nylon, PET (polyethylene terephthalate), polybarbonate or the like material ((resistance adjustment is carried out if necessary) having a thickness of 100–200 $\mu$m and having a volume resistivity of $10^{11}$–$10^{16}\Omega$, cm approx., and is extended around a rear surface roller 112, driving roller 115, tension roller 116 or the like. Usually, the primary transfer roller 110 is of a low resistance roller having a volume resistivity of not more than $10^{5}\Omega$, cm. By using a thin film as the intermediary transfer belt 109, a large electrostatic capacity such as several 100–several 1000 pF can be provided at the primary transfer nip $N_1$, and therefore, stabilized transferring current can be provided. In the foregoing, the primary transferring means is constituted by the primary transfer roller 110 and the bias voltage source 120.

Then, the toner image is transferred onto the transfer material 118 by secondary transferring means including the secondary transfer roller 111, rear roller 112, bias voltage source 121 or the like. In the secondary transfer station, the rear roller 112 having a low resistance and supplied with a proper bias or electrically grounded is provided inside the intermediary transfer belt 109 as an opposite electrode, and the intermediary transfer belt 109 is sandwiched by the rear roller 112 and the secondary transfer roller 111 having a low resistance and disposed outside to form a secondary transfer nip $N_2$. A transfer bias of the positive is applied to the secondary transfer roller 111 by a bias voltage source 121, and the secondary transfer roller 111 is contacted to the back side of the transfer material 118.

The photosensitive drum 101 having subjected to the primary transfer is cleaned by a cleaner 119 for removing the primary untransferred toner from the surface thereof, and then, the residual charge is removed by an exposure device 117 so that it can be used for the next image formation.

On the other hand, the surface of the intermediary transfer belt 109 which has been subjected to the secondary transfer, is cleaned by a cleaner 113 so that secondary untransferred toner is removed, and thereafter, is electrically discharged by a (discharging means) 114. The discharging 114 is an AC corona charging in many cases. Usually an opposite electrode is provided inside the intermediary transfer belt 109 to increase the discharging efficiency.

In the conventional system, there are following problems.

(1) when the intermediary transfer belt 109 has a high surface hardness, central void tends to occur in the toner image on the intermediary transfer belt 109 after the primary transfer.

(2) the transferring current is determinated mainly by an electrostatic capacity of the intermediary transfer belt 109, and therefore, the secondary transfer tends to become insufficient if the toner amount per unit area is large.

(3) when the attracting electrostatic force of the toner to the intermediary transfer belt is small, the intermediary transfer belt may repeatedly bent at the outer surface of the rollers 112, 115 and 116 or the like around which the intermediary transfer belt is stretched, as shown in FIG. 11, or the surface expansion and contraction are repeated, the unfixed Y, M, C, BK toner images superposed on the intermediary transfer belt surface can be disturbed.

The disturbance of the toner image occurs remarkably when the amounts of the toners constituting the toner image are large, and a full-color letter or the like is formed by superimposing a plurality of colors of toners on the intermediary transfer belt 109. This is because when the toner images are superimposed on the intermediary transfer belt 109, the toner of the toner image on the surface part (the toner image transferred afterward) scatters.

On the other hand, U.S. Pat. No. 5,243,392 discloses that in order to improve the secondary transfer efficiency, a charge easing time $\tau$ of the intermediary transfer belt is made 0.3–200 (sec). The charge easing time $\tau$ is the one theoretically determined.

However, the theoretical charge easing time $\tau$ is significantly different from the charge easing time measured actually.

SUMMARY OF THE INVENTION

Accordingly, it is a principal object of the present invention to provide an image forming apparatus wherein scattering of the toner on the intermediary transfer member due to the weakness of the electrostatic attraction force is prevented.

It is another object of the present invention to provide an image forming apparatus wherein the reduction of the transfer efficiency of the toner image from the intermediary transfer member onto the transfer material due to the property of the layer structure of the intermediary transfer member, is suppressed, while preventing the toner scattering.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 12 shows a relation between the charge easing time $\tau$ and line scattering and secondary transfer property.

FIG. 13 shows a relation among a coating thickness, charge easing time $\tau$, surface potential $V_0$, line scattering and a secondary transfer property.

DESCRIPTION OF THE PREFERRED EMBODIMENTS

Hereinafter, the embodiments of the present invention will be described with reference to drawings.

Embodiment 1

Figure 1:
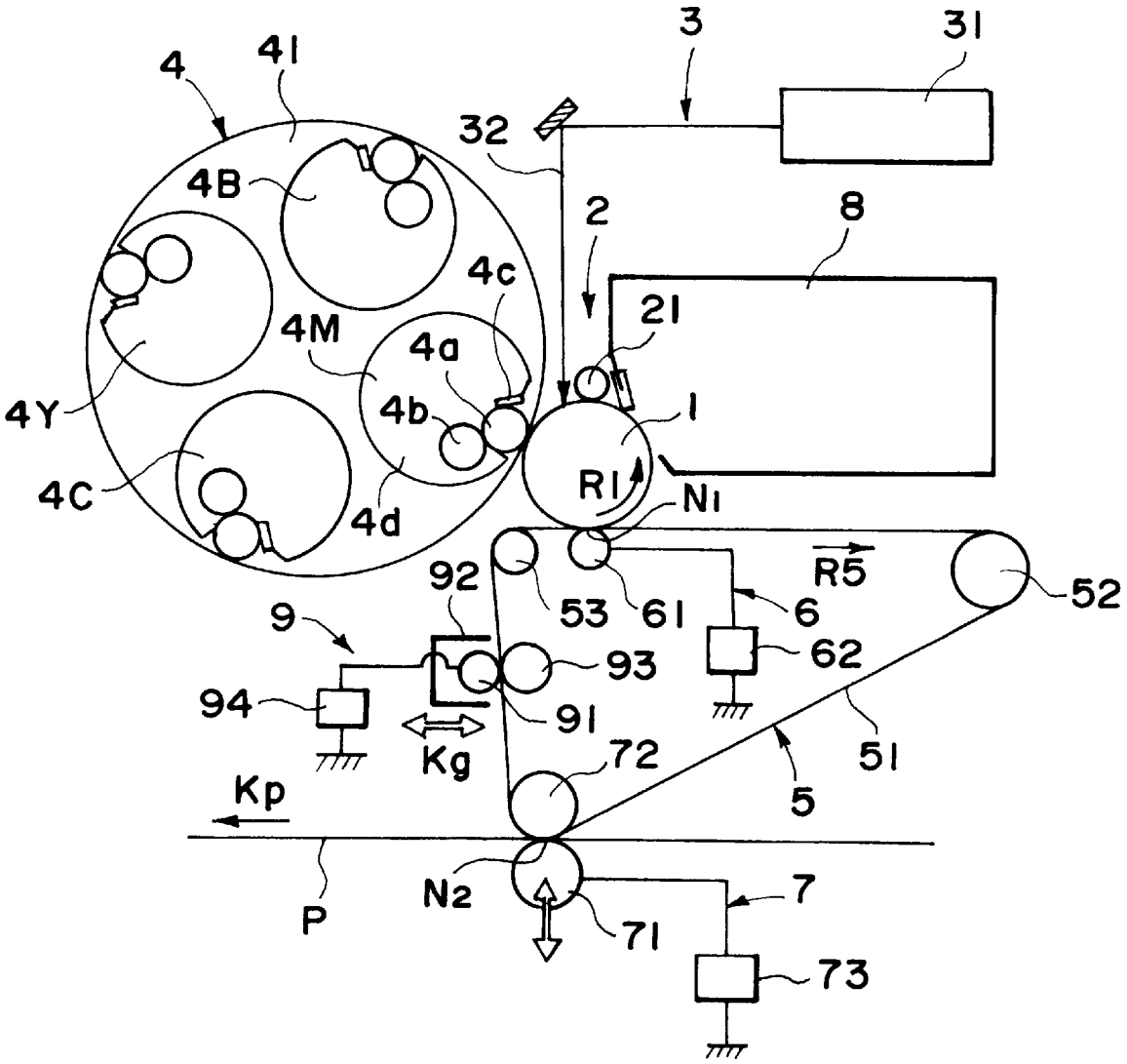
FIG. 1 is an illustration of an image forming apparatus according to Embodiment 1 of the present invention.

FIG. 1 is a schematic drawing which illustrates the general structure of the full-color image forming apparatus in the first embodiment of the present invention. First, the overall structure and operation of the image forming apparatus will be described with reference to the drawing.

The image forming apparatus illustrated in the drawing is a full-color image forming apparatus based on four primary colors, and comprises the following seven essential structural members (means): an image bearing member 1, visible image forming means 2, 3 and 4, an intermediary transfer member 5, a first transferring means 6, and a secondary transferring means 7. The general operation of the image forming apparatus, which is carried out by these essential structural members (means), is as follows. A visible image is formed on the image bearing member 1 by the visible image forming means 2, 3 and 4, and the visible image is first transferred onto the intermediary transfer member 5 by the primary transferring means. Thereafter, the visible image on the intermediary transfer member 5 is transferred onto a transfer medium P such as paper by the secondary transferring means 7. Next, the steps in the image forming operation will be described following the normal sequence.

The image bearing member illustrated in the drawing is an electrophotographic photosensitive member 1 (hereinafter, "photosensitive drum") in the form of a drum having a diameter of approximately 46 mm. The photosensitive drum 1 comprises a cylindrical base member of aluminum, and a photosensitive layer, for example, an organic photoconductor layer, which covers the surface of the cylindrical base member. The photosensitive drum 1 is rotatively driven in the direction of an arrow mark $R_1$ by a driving means (unillustrated).

The visible image forming means comprises a charging means 2, an exposing means 3, a developing means 4, and the like. The charging means 2 is provided with a charge roller 21, which is placed in contact with the photosensitive drum 1, and an electrical power source (unillustrated) for applying charge bias to the charge roller 21. In this embodiment 1, the surface of the photosensitive drum 1 is uniformly charged to negative polarity by the electrical power source through the charge roller 21.

The exposing means 3 is provided with a laser based optical system 31. The surface of the photosensitive drum 1 is exposed to a scanning laser beam 32 projected according to image data. As a result, charge is removed from the exposed portions; in other words, an electrostatic latent image is formed.

The developing means 4 comprises a rotary member 41, and four developing devices, that is, developing devices 4M, 4C, 4Y and 4B containing magenta, cyan, yellow and black developer (toner), correspondingly, which are mounted on the rotary member 41. In developing an electrostatic latent image, a developing device which contains specific color toner for developing an electrostatic latent image on the photosensitive drum 1 is positioned at a developing point at which the developing device is caused to face the surface of the photosensitive drum 1 by rotating the rotary member 41. Since, the four developing devices are the same in structure, they are described with reference to the magenta color developing device 4M. The developing device 4M comprises a rotatable sleeve 4*a*, a coating roller 4*b* for coating toner on the surface of the development sleeve 4*a*, an elastic blade 4*c* for regulating the thickness of the toner layer formed on the development sleeve 4*a*, and the like. In an image developing operation, non-magnetic, single component, negatively chargeable, magenta color toner in a toner container 4*d* is uniformly coated, while being triboelectrically charged, on the development sleeve 4*a*. Then, as development bias is applied so that the potential level of the development sleeve 4*a* becomes negative, relative to that of the photosensitive drum 1, the magenta toner is adhered to the latent image on the photosensitive drum 1; the latent image is developed in reverse.

The main structural component of the intermediary transfer member 5 is an intermediary transfer belt 51 (intermediary transfer member). The intermediary transfer belt 51 is basically an approximately 0.5–2.0 mm thick flexible endless belt, and is stretched around a driving roller 52, a follower roller 53, and an auxiliary secondary transfer roller 72, which will be described later, and the like, and is rotatively driven in the direction of an arrow mark $R_5$. The intermediary transfer belt 51 is pinched by the aforementioned photosensitive drum 1 disposed on the outward surface side of the belt, and a primary transfer roller 61 disposed on the inward surface side of the belt, which will be described later. The contact area between the surface of the intermediary transfer belt 51 and the surface of the photosensitive drum 1 constitutes the primary transfer nip $N_1$ (primary transfer point), which is in the form of a narrow rectangle elongated in the direction of the generatrix of the surface of the photosensitive drum 1.

The primary transferring means 6 comprises a primary transfer roller 61 and an electrical power source. The primary transfer roller 61 is 14 mm in diameter, and is composed of electrically conductive sponge rubber having an electrical resistance of no more than $10^5$ ohm/cm. It is placed in contact with the inward surface of the intermediary transfer belt 51. The power source 62 applies the primary transfer bias to the primary transfer roller 61. As the primary transfer bias in a range of +100–+1000 V is applied, with gradual increase, to the primary transfer roller 61 by the power source 62, the magenta toner image formed on the photosensitive drum 1 is transferred onto the intermediary transfer belt 51 (primary transfer). After the primary transfer, the photosensitive drum 1 is cleaned by a cleaner 8; the toner remaining on the photosensitive drum 1 after the primary transfer is moved by the cleaner 8. Then, the cleaned photosensitive drum 1 is subjected to the following image formation.

The above described image formation sequence comprising the charging, exposing, developing, transferring (first), and cleaning processes is carried out for remaining three colors, that is, cyan, yellow and black colors. As a result, four color toner images are superposed on the intermediary transfer belt 51.

The secondary transferring means 7 comprises a secondary transfer roller 71 disposed on the outward surface side of the intermediary transfer belt 51, and an auxiliary secondary transfer roller 72 disposed on the inward surface side of the intermediary transfer belt 51 to oppose the secondary transfer roller 71. The contact area between the surface of the secondary transfer roller 71 and the surface of the intermediary transfer belt 51 constitutes a narrow rectangular secondary transfer nip $N_2$ (secondary transfer point). To the secondary transfer roller 71, an electrical power source 73 which applies the secondary transfer bias to the secondary transfer roller 71 is connected, and the auxiliary secondary transfer roller 72 is floated. The four color toner images transferred (primary transfer) onto the intermediary transfer belt 51 are transferred (secondary transfer) all at once onto a transfer medium P such as paper as the secondary transfer bias is applied to the secondary transfer roller 71 from the power source 73.

After the secondary transfer, the intermediary transfer belt 51 is cleared of the charge remaining on the surface thereof, by discharging means 9. The discharging means 9 comprises a discharge roller 91, a housing 92 movable in the direction of an arrow mark $K_9$, and an auxiliary roller 93 which opposes the discharge roller 91, with interposition of the intermediary transfer belt 51. In discharging the intermediary transfer belt 51, the housing 92 is moved in the direction of the arrow mark $K_9$ so that the intermediary transfer belt 51 is pinched between the discharge roller 91 and the auxiliary roller 93, and a predetermined bias voltage is applied by the power source 94. As a result, the residual charge on the intermediary transfer belt 51 is removed; in other words, the intermediary transfer belt 51 is initiated. The intermediary transfer belt 51 can be discharged by a contact type charging means, which does not depend on corona discharge; as one of the effects of using low resistance rubber material as the material for the base layer of the intermediary transfer belt 51, which will be described later, the residual charge can be removed with the use of a contact type discharging means.

The transfer medium P onto which the four color toner images have been transferred (secondary transfer) by the secondary transferring means 7 is heated and pressed by a fixing apparatus (unillustrated) so that the toner images are fixed to the surface of the transfer medium P. Thereafter, it is discharged from the main assembly of the image forming apparatus.

In an image forming operation comprising the aforementioned sequence of processes, a process speed Vp is set at 10.0 cm/sec, and the transfer medium P is conveyed in the direction of an arrow mark Kp by a transfer medium conveying means (unillustrated).

Next, the second image bearing member 5, the secondary transferring means 7, and the discharging means 9, which characterize the present invention, will be described in detail.

Figure 2:
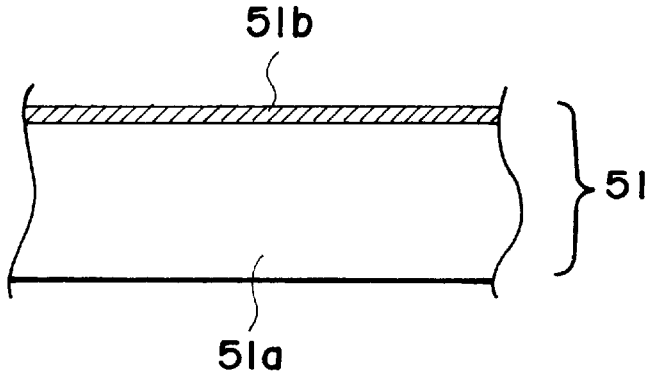
FIG. 2 is a longitudinal sectional view showing a layer structure of the intermediary transfer belt.

Referring to FIG. 2, the intermediary transfer belt 51 comprises a base layer 51*a* and a layer 51*b* coated on the base layer 51*a*. The base layer 51*a* is in the form of a seamless cylinder which is 1 mm in thickness, 220 mm in width, and approximately 140×π mm in peripheral length. It is formed of nitrile butadiene rubber, ethylene propylene rubber, or the like, which has a hardness of 60 deg. in JIS-A scale, and the volumetric resistivity of which has been adjusted to approximately $1\times10^4$ ohm.cm with admixture of carbon, titanium oxide, tin oxide, and the like. One of the methods for forming the base layer 51*a* is as follows: the rubber is extruded in a manner to cover a reinforcement fiber core, and is hardened. This method produces a very strong base layer 51*a* which stretches or shrinks very little.

As for the high resistance layer 51*b* coated on the base layer 51*a*, urethane binder, or the like, in which a mold releasing agent such as Teflon or the like has been dispersed is coated on the base layer 51*a* to a thickness of approximately 50 μm. As for the coating method, spraying, dipping, and the like can be used. In this embodiment, six intermediary transfer belts were made, the charge attenuation times τ of which were set at no more than 1 second, 2 seconds, 5 seconds, 50 seconds, 500 seconds, and no less than 1000 seconds by adjusting the resistance value of the material for the layer 51*b*, and were subjected to an evaluation, which will be described later.

Next, a method for measuring the charge attenuation time $\tau$ of the base layer 51*a* will be described.

The length of the charge attenuation time $\tau$ is generally determined by the resistance R and capacitance C of the intermediary transfer belt: $\tau=R\cdot C$. The resistance of the intermediary transfer belt 51 in this embodiment is rendered ignorably small, compared to the resistance of the coated layer 51*b*, to yield a sufficient amount of transfer current (volumetric resistivity is desired to be in a range of $10^2$–$10^7$ ohm.cm), and therefore, the values of the aforementioned R and C of the intermediary transfer belt 51 are determined by the coated layer 51*b*, or the surface layer. However, in reality, even if each parameter is individually measured, and the charge attenuation time $\tau$ is calculated according to the formula: $\tau=R\cdot C$, the calculated value does not completely match the actual charge attenuation time. Therefore, it is desirable that the charge attenuation time $\tau$ is directly measured with the use of a jig. As the resistance of the base layer 51*a* becomes unignorably large, the apparent charge attenuation time $\tau$ of the intermediary transfer belt becomes large, but scattering of toner is not reduced since the capacitance of the intermediary transfer belt 51 is small. Therefore, the secondary transfer performance also deteriorates.

As for the method for measuring the resistance of the base layer 51*a*, it is simplest to measure the resistance before the layer 51*b* is coated. For example, it can be measured in the following manner. The base layer 51*a* is molded as an endless belt which is approximately $140\times\pi$ mm in peripheral length, and 220 mm in width. Then, a piece having a predetermined size is cut from the molded belt, and the resistance of this piece is measured by a high resistance meter 8340A of Advantest Co. (probe electrode diameter: 50 mm; guard electrode diameter: 70 mm in internal diameter and 80 mm in external diameter; opposing electrode: one in conformity with JIS-K6911). In measuring the resistance of the piece of the belt, the piece is pinched from the top and bottom, and a voltage of 500 V is applied. It should be noted here that, if necessary, the voltage to be applied may be lowered since breakdown may occur depending on the amount of the resistance.

Next, referring to FIG. 3, a method for measuring the charge attenuation time $\tau$ will be described.

Figure 3:
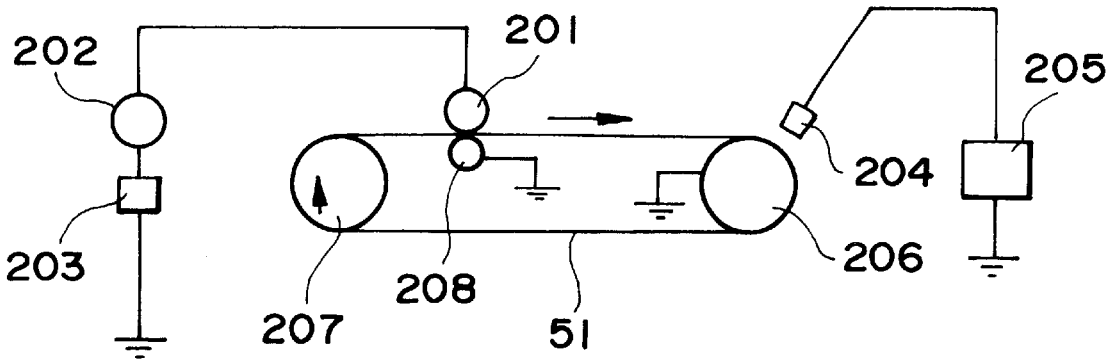
FIG. 3 is an illustration of a measuring method of a charge easing time $\tau$.
Figure 4:
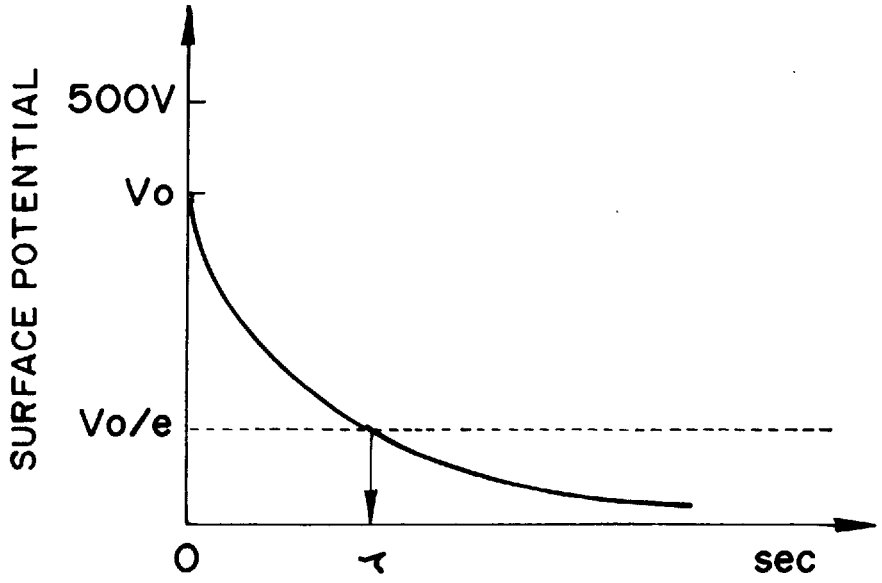
FIG. 4 shows a change of the surface potential of the intermediary transfer belt with time.

In FIG. 3, the intermediary transfer belt 51 is stretched around a driving roller 207 and a metallic tension roller 206 of a measuring jig, and is rotated in the direction of an arrow mark at a speed of 10.0 cm/sec. The intermediary transfer belt 51 is pinched by a charge roller 201 (made of the same material as the discharge roller 91, which will be described later) and an opposing metallic auxiliary roller 208, at a charging point, and is charged by an AC power source 202, the output of which is approximately 3 kV in peak-to-peak voltage Vpp, and a DC power source 203, the output of which is +500 V. The intermediary transfer belt 51 charged by the charge roller 201 is measured for surface potential by a surface potentiometer 205, the probe 205 of which is positioned at a point which is one second away from the charging point in terms of the rotational time of the belt. After the surface potential of the intermediary transfer belt 51 is measured, the driving roller 207 is stopped, and then, the attenuation of the surface potential of the belt is measured. When measured actually, the surface potential of the intermediary transfer belt 51 attenuated as shown in FIG. 4, in which $V_0$ represents the surface potential of the intermediary transfer belt 51 at the moment when the intermediary transfer belt 51 is stopped, and $\tau$ represents the time which elapsed before the surface potential of the intermediary transfer belt 51 attenuated to $V_0/e$, e being the base of natural logarithm (e=2.71828 . . . ). In order to make the aforementioned six intermediary transfer belts different in charge attenuation time $\tau$ (no more than one second to no less than 1000 seconds), six different materials were selected for the layer 51*b* from among the materials, the volumetric resistivities of which were in an approximate range of $10^{12}$–$10^{16}$ ohm.cm. Since the volumetric resistivity of the coated layer 51*b* is very high, the measured volumetric resistivity of the intermediary transfer belt 51 is very dependent on the voltage at the time of the measurement, and the thickness of the coated layer 51*b*. Therefore, it is desirable that the charge attenuation time $\tau$ is directly measured by the method described above.

In this embodiment, the measurement was made in an environment with normal temperature (23° C.) and humidity (50% RH).

The secondary transfer roller 71 of the secondary transferring means 7 is a rubber roller which is 18 mm in diameter, and is made of foamed EPDM which is approximately 40 deg. in hardness (ASCA-C scale), and approximately $10^4$ ohm.cm in volumetric resistivity. As for the material for the secondary transfer roller 71, low resistance urethane rubber, chloroprene rubber, NBR, or the like may be used, in addition to the material used in this embodiment. To the transfer bias power source 73, a voltage in a range of approximately +1000–+2000 V was applied while adjusting the voltage, so that a transfer current of approximately 10 $\mu$A flowed while a transfer medium was passed.

The discharge means comprised a discharge roller 91 made of the same material as the material for the charge roller 21. The charge roller 21 was a well-known contact type charge roller. It was a cylindrical member having an overall diameter of approximately 12 mm, and comprised: an approximately 3 mm thick bottom layer of electrically conductive elastic rubber; a 100–200 $\mu$m thick middle layer having a medium volumetric resistivity of approximately $10^6$ ohm.cm; and an adhesion preventive top layer (nylon resin or the like), the thickness of which was no less than 10 $\mu$m and no more than 100 $\mu$m. To the charge roller 91, a combination of an AC voltage having a peak-to-peak voltage Vpp of approximately 3 kV, and a DC voltage in a range of +100–+1000 V was applied from an electrical power source 94, and the opposing auxiliary roller 93 was kept floated.

Under the above described conditions, images were actually formed for evaluation. Generally speaking, the depth of a recorded image is improved in proportion to the amount of the toner contained in the image, that is, the amount of the toner contained in an image formed on the photosensitive drum 1, and also, the amount of the toner which is scattered greatly changes depending on the amount of the toner contained in the image formed on the photosensitive drum 1. Therefore, the amount of the toner to be adhered to the photosensitive drum 1 was adjusted in consideration of the above fact. More specifically, the amount of the toner to be adhered to the photosensitive drum 1 was adjusted so that the amount of the toner contained in a solid image of yellow, magenta, cyan or black color became approximately 0.7 mg/cm$^2$, and under this condition, letters of compound colors (blue, green, red, or the like) were printed and were evaluate in terms of the scattering of toner from the letters, that is, the images formed of lines. The amount of the toner scattered under the above described condition was assumed to be greater by 10–50%, compared to the amount of the toner scattered in an average image. All the toners employed in this embodiment were non-magnetic, single component, negatively chargeable toners. FIG. 12 shows the results of the evaluations of the toner scattering and the secondary transfer, regarding the aforementioned intermediary transfer belts which were different in charge attenuation time τ.

Figure 5:
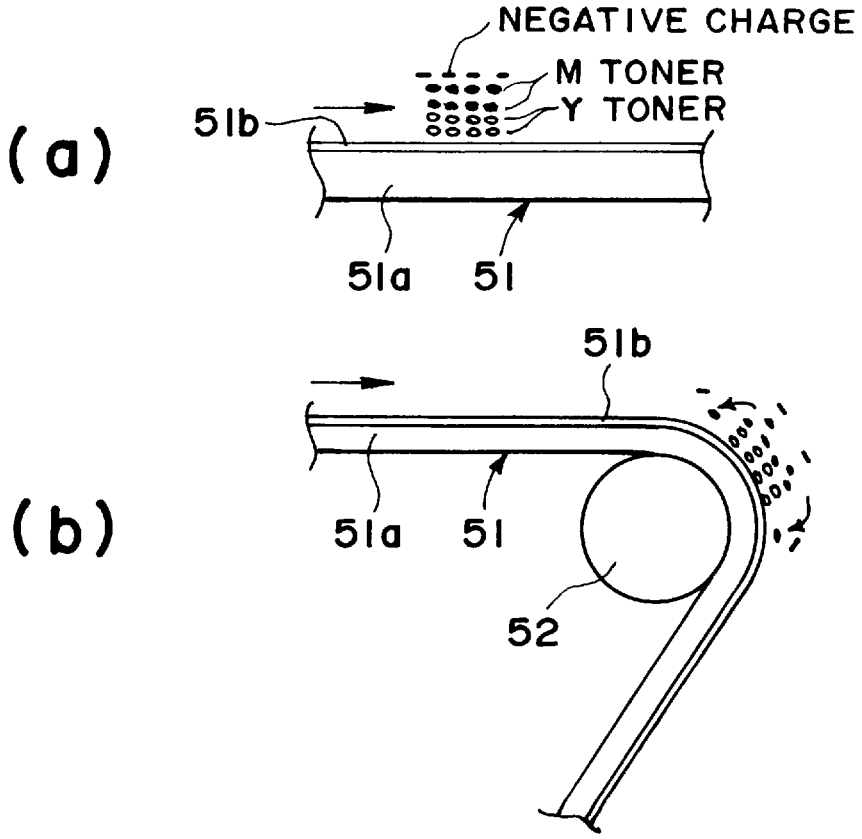
FIG. 5, (*a*) shows a state in which M toner is superimposed on a Y toner on a conventional intermediary transfer belt surface, and (*b*) shows a state in which the M toner on the Y toner is scattered when the intermediary transfer belt is bent by a roller outer surface.

Among the results given in FIG. 12, the scattering of the toner from the lines (line washout) seems to be caused by the following mechanism. Referring to FIG. 5, (*a*), when a red letter, for example, is formed by the toners, a yellow toner layer and a magenta toner layer are transferred (primary transfer), or superposed, onto the intermediary transfer belt 51 in this order. While the four color toner images are superposed on the intermediary transfer belt 51, a given point of the intermediary transfer belt 51 passes the rollers 52, 72 and 53 a number of times, and each time the given point of the intermediary transfer belt 51 passes the rollers, it is bent; in other words, the outward portion of the belt is stretched, and the inward portion of the belt is compressed, compared to a straight portion of the belt. As this bending occurs to the given point of the belt, the magenta toner superposed on the yellow toner is subjected to the shock from the bending, that is, the stretching and compressing, of the intermediary transfer belt 51, and the electrical repulsion from the yellow toner at the same time. As a result, the scattering of the magenta toner as illustrated in FIG. 5, (*b*) occurs.

Figure 6:
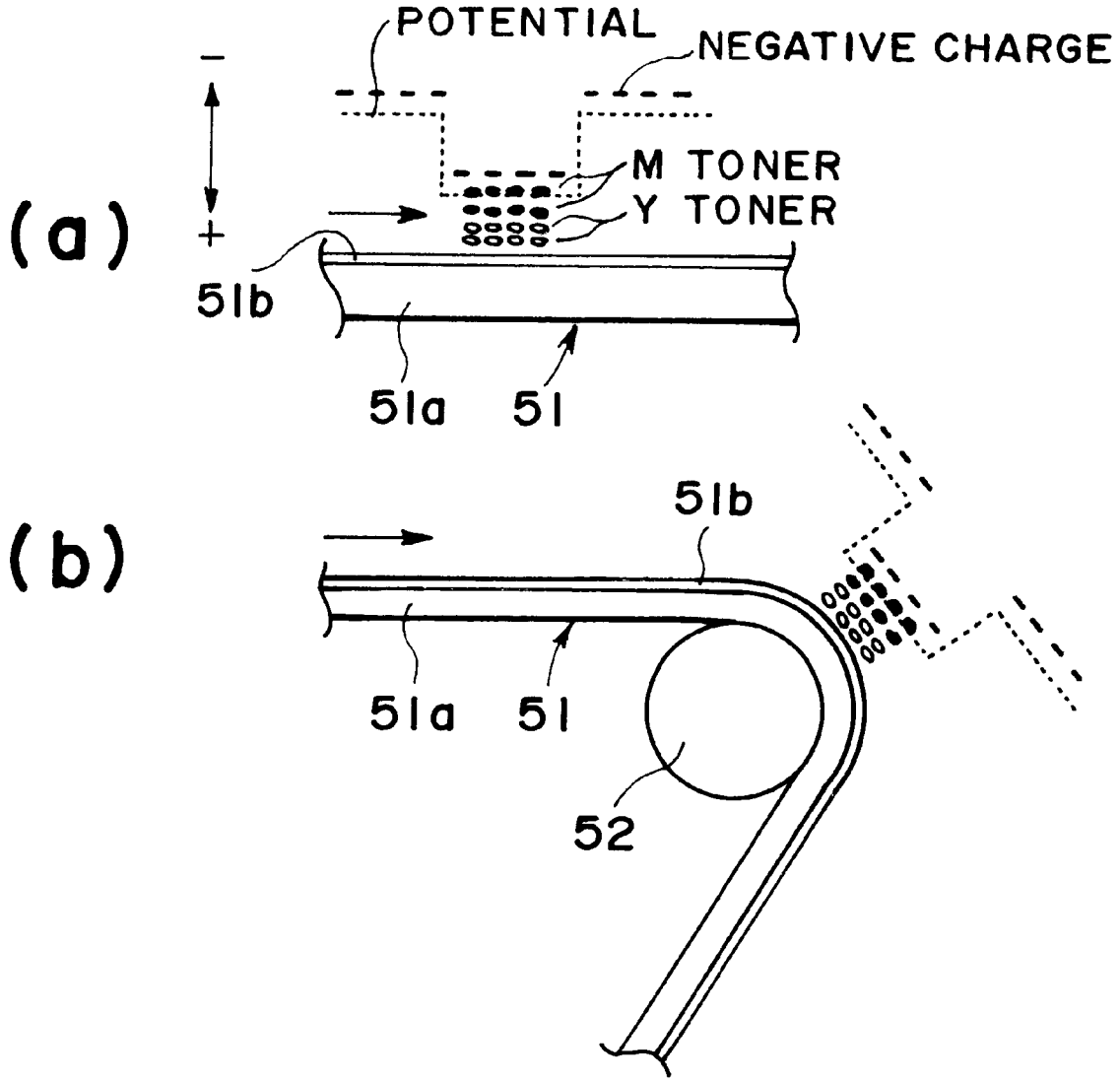
FIG. 6, (*a*) shows a state in which M toner is superimposed on Y toner on the intermediary transfer belt surface in the apparatus according to Embodiment 1, and (*b*) shows a state in which the M toner on the Y toner does not scatter even if the intermediary transfer belt is bent by the roller outer surface.

In this embodiment in which a reversal development system is employed, when the charge attenuation time τ of the intermediary transfer belt 51 is long, the surface potential of the photosensitive drum 1 correspondent to the background region of an image (dark portion potential) is greater in terms of negativity than the surface potential of the photosensitive drum 1 correspondent to the actual image portion (light portion potential), that is, the region to which the toner is to adhere. Therefore, the amount of negative charge which transfers from a photosensitive drum region with less toner is more than that from a photosensitive drum region with more toner. As a result, "walls" of negative charge are formed on the intermediary transfer belt 51 as illustrated in FIG. 6, (*a*), due to the potential difference between the two regions. More specifically, the aforementioned walls are formed due to the difference in the light region potential and dark region potential after the primary transfer (positive polarity). It is thought that these walls prevent the magenta toner (negatively charged) on the yellow toner layer from being scattered in the adjacencies.

In this first embodiment, the time it took for the intermediary transfer belt 51 to be rotated once was approximately 5 seconds. In the case of an intermediary transfer belt with a charge attenuation time τ longer than 5 seconds, the magenta toner is electrostatically prevented from scattering, and in the case of an intermediary transfer belt with a charge attenuation time τ of less than 5 seconds, the scattering of the magenta toner could not be prevented. This is thought to be due to the following reason. That is, the intermediary transfer belt with the longer charge attenuation time τ could prevent the magenta toner from scattering throughout a full rotation of the intermediary transfer belt, whereas in the case of the intermediary transfer belt with the shorter charge attenuation time τ, the charge on the background region completely attenuates before the intermediary transfer belt is rotated a full turn and charged again by the primary transfer nip $N_1$, and therefore, the scattering of the magenta toner cannot be prevented electrostatically. Further, this phenomenon, that is, the scattering of the toner, is more apparent when the diameters of the rollers 52, 53, and 72 in contact with the inward surface of the intermediary transfer belt 51 (in this embodiment, the diameters are 30 mm, 16 mm, and 30 mm, correspondingly) is smaller. Therefore, in order to effectively prevent the scattering of the toner, it is necessary to make the charge attenuation time τ of the intermediary transfer belt 51 longer than the time T (second) it takes for the belt 51 to be rotated one full turn. Also, the magnitude of the shock, to which the magenta toner is subjected as the intermediary transfer belt 51 is bent, that is, as the portions thereof are stretched or compressed, is affected by the thickness of the base layer 51*a* of the intermediary transfer belt 51; the thicker the base layer 51*a*, the worse the shock. This is the reason why the upper limit in the thickness of the base layer 51*a* in this embodiment 1 was set at 2 mm, whereas the lower limit was set at 0.5 mm to provide the intermediary transfer belt 51 with sufficient strength.

On the other hand, in the case of the secondary transfer, if the charge attenuation time τ is too long, such a phenomenon that the toner cannot be entirely attracted onto a transfer medium P when the amount of the toner is large (toner fails to be entirely transferred through the secondary transfer process) occurs.

This seems to be due to the following reason. In the case of an intermediary transfer belt 51 with a long charge attenuation time τ, the toner on the intermediary transfer belt 51 (in particular, yellow toner which passes the primary transfer point more times than the other color toners) is charged to a higher level of negative polarity as the primary transfer process is repeated. This high level charge is not neutralized by the positive charge during the secondary transfer process, because the resistance of the coated layer 51*b* of the intermediary transfer belt 51 is too high. In other words, the negative triboelectric charge of the toner becomes too much, interfering the transfer (secondary transfer) of the toner onto the transfer medium P. As a result, a certain amount of the toner remains on the intermediary transfer belt 51. According to the evaluation in this embodiment, the charge attenuation time τ of the intermediary transfer belt 51 is desired to be no more than 500 seconds.

In addition, the effects of the thickness of the coated layer 51*b* of the intermediary transfer belt 51 was evaluated. In this test, seven intermediary transfer belts 51 having thicknesses of 1 μm, 2 μm, 5 μm, 20 μm, 50 μm, 80 μm, and 100 μm were made using the same material that was coated to a thickness of 50 μm to give the intermediary transfer belt 51 a charge attenuation time τ of 50 seconds. Then, these seven intermediary transfer belts 51 were used to form the aforementioned images, and the formed images were comparatively evaluated. The results of the evaluation are given in FIG. 13.

According to FIG. 13, in order to prevent the occurrence of the line washout, the thickness of the coated layer 51*b* (hereinafter, "coat thickness") is desired to be no less than 2 μm, whereas from the standpoint of secondary transfer performance, it is desired to be no more than 80 μm. Also, it is evident from FIG. 3 that between the two concerns, the line washout is greatly affected by the potential level $V_0$, described regarding the method for measuring the charge attenuation time τ, to which the intermediary transfer belt 51 is charged, in addition to the charge attenuation time τ. The reason why the rate of the charge attenuation is drastically greater in the case of an intermediary transfer belt 51 having a coat thickness of no more than 5 μm than in the case of an intermediary transfer belt 51 having a coat thickness of no less than 20 μm is due to the fact that the electrostatic capacity of the intermediary transfer belt 51 increases as the coat thickness decreases, and the charging performance of the charge roller 201 illustrated in FIG. 3 is not sufficient to accommodate the increase.

It should be noted here that the fact that the potential level $V_0$ is low means that the walls created by the regions with no toner, which were illustrated in FIG. 6, (*a*), are also low.

Further, the charge attenuation time $\tau$ is not supposed to change, in view of the relationship ($\tau$=R·C) among the charge attenuation time $\tau$, the capacitance C, and resistance R, according to which increase in the capacitance C is offset (canceled) by decrease in the resistance R. Yet, FIG. 3 shows that the thinner the coat thickness, the shorter the actually measured charge attenuation time $\tau$. This contradiction is thought to be caused because the change in coat thickness and the change in resistance are not proportional to each other. In other words, as the coat thickness is reduced, the apparent resistance of the intermediary transfer belt 51 increases at a rate far greater than the rate of the coat thickness reduction, due to such phenomenons as leak, tunnel effect, and the like, and therefore, the charge attenuation time $\tau$ decreases.

Further, FIG. 3 indicates that as the coat thickness increases, the secondary transfer performance declines. This is thought to occur because the capacitance of the intermediary transfer belt 51 becomes so small that the secondary transfer current does not flow in an amount sufficient to transfer a large amount of toner.

As described above, in this embodiment 1, the intermediary transfer belt 51 comprising the base layer 51*a* and a surface layer 51*b* was employed, wherein the base layer 51*a* was a 0.5–2.0 mm thick elastic rubber belt with a low resistance ($10^2$–$10^7$ ohm.cm in volumetric resistivity), and the surface layer 51*b* was a 2–80 $\mu$m thick coated layer with a high resistance. The charge attenuation time $\tau$ of the intermediary transfer belt 51 was rendered no less than the time a single rotational cycle of the intermediary transfer belt 51 takes (5 seconds in this embodiment 1), and no more than 500 seconds. As a result, the intermediary transfer belt 51 in this embodiment produced the following effects.

(1) The usage of the highly strong and yet flexible rubber as the base layer of an intermediary transfer belt made it possible to produce an intermediary transfer belt which is very durable, and does not cause central void transfer during the primary transfer process (durability can be further increased with addition of a reinforcement core such as a fabric core).

(2) The high resistance layer 51*b* was coated on the low resistance rubber base layer 51*a* to adjust the charge attenuation time $\tau$ of the intermediary transfer belt to a proper length, and therefore, even when a large amount of toner was transferred onto the intermediary transfer belt 51, the toner was prevented from being scattered by the deformation of the intermediary transfer belt 51 which occurs as the intermediary transfer belt 51 was rotated, and as a result, each toner image on the intermediary transfer belt 51 could be held in a desirable condition.

(3) The high resistance coated layer 51*b* of the intermediary transfer belt 51 was rendered thin, being in a range of 2–80 $\mu$m, and therefore, a larger capacitance than that of a resin belt, or a belt or a prior type, could be realized, and the larger capacitance could generate a larger amount of secondary transfer current. As a result, the toner was very efficiently transferred from the intermediary transfer belt 51 onto the transfer medium P; a desirable secondary transfer performance was realized.

Embodiment 2

Figures 14, 15:
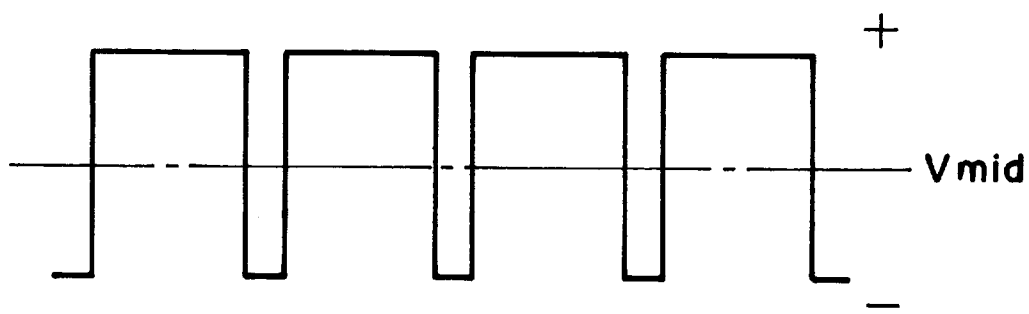
FIG. 14 shows a relation among a relative speed, toner scattering, secondary transfer property, color misregistration and pitch non-uniformity.
FIG. 15 shows a bias waveform in Embodiment 5 of the present invention.

In the first embodiment, the effects of the present invention were evaluated under the condition that the surface speed $v_1$ of the intermediary transfer belt 51 at the secondary transfer point, and the surface speed $v_2$ of the transfer medium P when it is passing the secondary transfer point, were substantially the same. However, it was known that the secondary transfer efficiency could be improved by providing a difference of +0.5%–+2% between $v_1$ and $v_2$. The inventors of the present invention paid attention to this fact, and re-examined the optimum values for the charge attenuation time $\tau$ of the intermediary transfer belt 51 and the coat thickness. In this re-examination, the conditions other than the establishment of the speed difference between the belt 51 and the medium P were kept the same as in the first embodiment. In terms of the coat thickness, the results of the re-examination were not much different from the results in the first embodiment. In terms of the charge attenuation time $\tau$, however, the secondary transfer performance was greatly improved even in a charge attenuation time territory in which the charge attenuation time $\tau$ was longer than 1000 seconds (FIG. 14).

Here, the method for measuring the surface speed $v_1$ of the intermediary transfer belt 51 at the secondary transfer point, and the surface speed $v_2$ of the transfer medium P when it is passing the secondary transfer point, will be described.

The surface speed $v_1$ of the intermediary transfer belt 51 at the secondary transfer point was measured with a non-contact type speed sensor such as a laser Doppler type speed sensor, while keeping the transfer roller 71 away from the intermediary transfer belt 51. As for the surface speed $v_2$ of the transfer medium P, it was measured using also the aforementioned speed sensor, with the transfer medium P being pinched between the intermediary transfer belt 51 and the secondary transfer roller 71 (in other words, it was measured under the same condition as the condition under which the secondary transfer process was carried out).

As for the definitions of the positive and negative directions in speed difference between the intermediary transfer belt 51 and the transfer medium P, the positive direction means: $v_2>v_1$, and the negative direction means: $v_2<v_1$. According to the results given in FIG. 14, in terms of the secondary transfer performance, the speed difference is desired to be no less than ±0.5%, preferably no less than ±1%, where the transfer efficiency was improved while the secondary transfer process was desirably carried out even when the charge attenuation time $\tau$ was approximately 10,000 seconds. Under the above condition, the scattering of the toner did not occur. Further, similar results could be obtained even when the charge attenuation time $\tau$ was approximately $10^5$ seconds; it became evident that practically, it was unnecessary to be concerned about the upper limit value of the charge attenuation time $\tau$. Further, the central tranfer void phenomenon did not occur (it sometimes occurred when the surface speed difference was 0%, and the charge attenuation time $\tau$ was no less than 1000 seconds).

However, as the surface speed difference was increased, the degree of misalignment among the four color toner images increased, producing wrong colors, and also, pitch error (blurring) in the direction of the transfer medium conveyance; when the surface speed difference was no less than +2%, or −1.5%, image deterioration occurred.

The reason why the above phenomenon occurred when the surface speed difference was on the negative side is because applying external force to the intermediary transfer belt 51 in the decelerating direction, through the transfer medium P, at the secondary transfer point, is likely to destabilize the speed of the intermediary transfer belt 51 more than applying external force to the intermediary transfer belt 51 in the accelerating direction, through the transfer medium P, at the secondary transfer point. It may be guessed that this may have something to do with the fact that the driving roller 52 was positioned on the upstream side of the secondary transfer roller.

The above description may be summarized as follows. In the second embodiment, an approximately 0.5–2.0 mm thick elastic rubber belt with a low resistance (approximately $10^2$–$10^7$ ohm.cm in volumetric resistivity) was used as the base layer 51*a* of the intermediary transfer belt 51, and an approximately 2–80 $\mu$m thick high resistance layer 51*b* was coated, as the surface layer, on the base layer 51*a*. The charge attenuation time $\tau$ of the intermediary transfer belt 51 was rendered no less than that the time it took for the intermediary transfer belt 51 to be rotated a full cycle, and the conveyance speed of the transfer medium was differentiated from the surface speed of the intermediary transfer belt 51 by +0.5%–+2.0%, or −0.5%–−1.5%. The obtained results were substantially the same as those described in the first embodiment. In addition, according to this embodiment, it was practically unnecessary to be concerned about the upper limit of the charge attenuation time $\tau$ of the intermediary transfer belt 51. Therefore, substantially greater latitude was afforded in manufacturing the high resistance coated layer 51*b*.

In the preceding description, the speed of the intermediary transfer belt 51 was defined as the surface speed of the intermediary transfer belt 51 at the secondary transfer point. This is because the surface speed of the intermediary transfer belt 51 across the straight portion thereof is substantially different from the surface speed of the intermediary transfer belt 51 across the bent portion, depending on the thickness of the elastic layer 51*a*; the speed increases across the bent portion. In other words, it was important to define the speed of the intermediary transfer belt 51 as the surface speed of the intermediary transfer belt 51, because the intermediary transfer belt 51 had curvature at the secondary transfer point.

Embodiment 3

Figure 7:
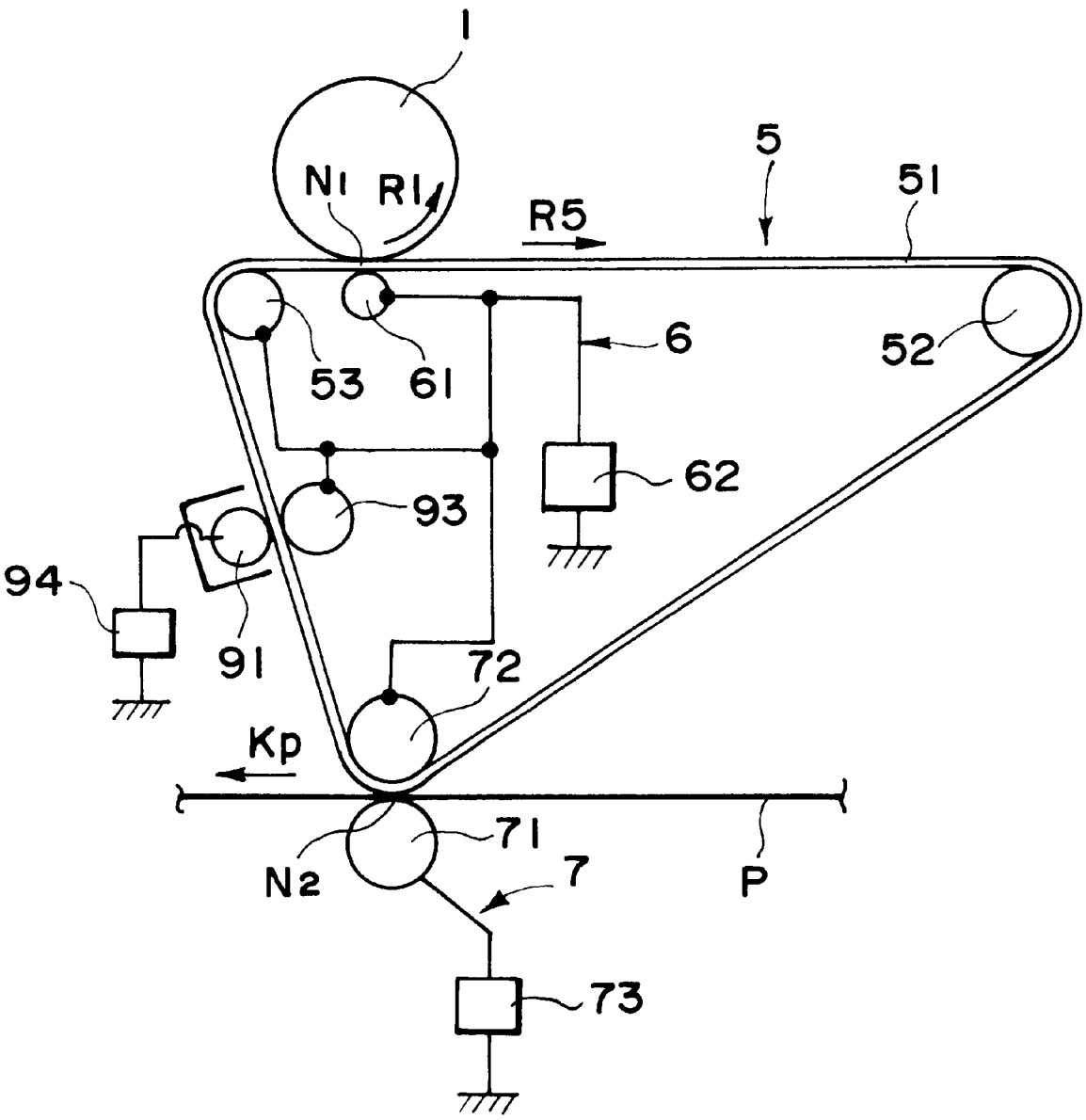
FIG. 7 is an illustration of a second image bearing member in Embodiment 3 of the present invention.

FIG. 7 depicts the third embodiment.

Since the base layer 51*a* of the intermediary transfer belt 51 in this embodiment is extremely low in electrical resistance, the voltage on the inward facing surface of the intermediary transfer belt 51 remains virtually stable. Therefore, it is possible to apply DC voltage from a secondary transfer roller 51 and a discharge roller 91 simply by providing a primary transfer roller 61 with voltage while floating other rollers 53, 72, and 93, as illustrated in FIG. 1. However, the AC voltage applied to the discharge roller 91 sometimes attenuates between the discharging point and the primary transfer point if the resistance of the base layer 51*a* of the intermediary transfer belt 51 is higher than a certain level. More specifically, if the volumetric resistivity of the rubber material for the base layer 51*a* is increased to a value in a range of $10^5$–$10^7$ ohm.cm, there is a tendency that when a combination of an AC bias in the form of a sine wave having a voltage of 2.5 kVpp and a frequency of 2 kHz, and a DC bias having an approximate voltage of +100 V, is applied to the discharge roller 91 by the high voltage power source 74, the AC voltage applied in the thickness direction of the coated layer 51*b* is liable to attenuate, and hence discharge efficiency is liable to deteriorate. On the other hand, if the resistance of the rubber material for the base layer 51*a* is reduced, it becomes necessary to provide sufficient withstand voltage between the base layer 51*a* and the surrounding members. In other words, in terms of affording more latitude in apparatus design, it is better to set the resistance of the rubber material for the base layer 51*a* as high as possible.

The problem described above can be reduced in magnitude by connecting the rollers 53, 61, 72, 93, and the like, disposed on the inward facing side of the intermediary transfer belt 51, to the primary transfer power source, as illustrated in FIG. 7. In particular, in this third embodiment, an opposing roller 93 to a discharge roller 91 was rendered electrically conductive and was connected to the primary transfer power source. The results were very desirable (in this embodiment, the surface of the driving roller 52 was covered with insulative rubber to provide it with friction, and therefore, it was left floated).

The above described structure sometimes displays its effectiveness in stabilizing the DC voltage applied to each bias roller, provided that the length of the intermediary transfer belt 51, and the positioning of the rollers 53, 61, 72 and 93, disposed on the inward facing side of the intermediary transfer belt 51, are properly adjusted.

Embodiment 4

Figure 8:
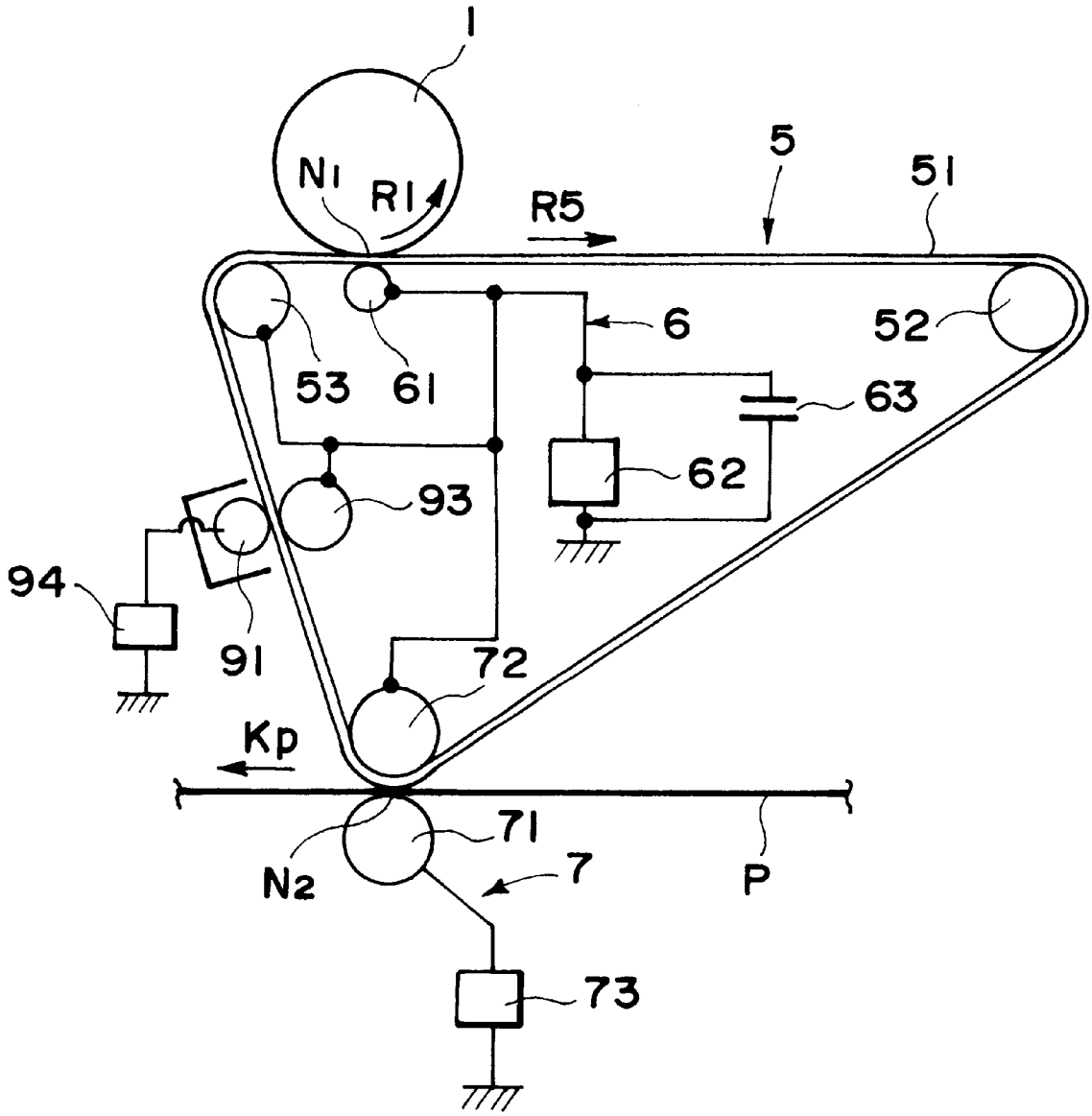
FIG. 8 is an illustration of a second image bearing member in Embodiment 4 of the present invention.

FIG. 8 depicts the fourth embodiment of the present invention. This fourth embodiment shows improvement possible on the preceding first, second and third embodiments. In the preceding embodiments, the discharging AC current which is flowed through the discharge roller 91 flows to the ground through the primary transfer power source 62.

Therefore, if the AC impedance of the primary transfer power source 62 itself is unignorably high compared to that of the intermediary transfer belt 51, the AC voltage applied by the discharge power source 94 is divided between the intermediary transfer belt 51 and the power source 62. As a result, the high AC voltage divided by the power source 62 is applied to the low resistance base layer 51*a* of the intermediary transfer belt 51.

In the above described case, insertion of a bypass condenser 63 between the power source 62 and the ground makes it possible to accurately apply the AC voltage generated by the power source 94, between the discharge roller 91 and the opposing roller 93. As for the aforementioned bypass condenser 63, when a bypass condenser having a capacity of approximately $1\times10^4$ pF or more was used, desirable results could be obtained. For example, when a bypass condenser having a capacity of 10 pF was used, effective results could not be obtained.

Embodiment 5

In the preceding third and fourth embodiments, the arrangement in which a voltage in the form of a sine wave having a 2.5 Vpp and a frequency of 2 kHz was used as the discharging AC bias applied to the discharge roller 91 was described. The arrangement is definitely very effective if the secondary transfer efficiency is 100%, but when there remains toner on the intermediary transfer belt 51 after a secondary transfer process, unillustrated cleaning means must be separately provided. In such a case, the cleaning means must be disposed on the upstream side of the discharge roller 91, relative to the rotational direction of the intermediary transfer belt 51, because if toner remains on the surface of the intermediary transfer belt 51 after a transfer process, problems such as the scattering of toner in the adjacencies occurs as AC bias is applied by placing the discharge roller 91 in contact with the belt 51 to discharge the belt 51.

However, if the AC bias in the form of a sine wave applied to the discharge roller 51 is changed to a bias in the form of a rectangular wave having 60–90% of the wave components on the positive side, and 40–10% on the negative side, as illustrated in FIG. 15, the aforementioned scattering of toner can be prevented; the residual charge on the intermediary transfer belt 51 can be removed; and in addition, the polarity of the post-transfer residual toner can be reversed (from negative to positive). Therefore, the aforementioned cleaning means becomes unnecessary. This is due to the following reason. As the polarity of the residual toner on the intermediary transfer belt 51 is reversed to positive, it becomes possible to transfer normally (negatively) charged toner from the photosensitive drum 1 onto the intermediary transfer belt 51 through a primary transfer process, while recovering the residual toner on the intermediary transfer belt 51, onto the photosensitive drum 1; it becomes possible to carry out "simultaneous toner swapping". In other words, the residual toner on the intermediary transfer belt 51 from the secondary transfer process is ultimately recovered by a photosensitive drum cleaner 8. As is evident from this explanation, the apparatus in accordance with the present invention can be simplified with the use of asymmetrical AC bias as the bias to be applied to the discharge roller 9. More specifically, a bias comprising an AC voltage having a frequency of 2 kHz, a duty ratio of 80% on the positive side, and a peak-to-peak ratio of 2.5 kV, and a DC voltage which sets the middle voltage Vmid of the bias at approximately +100 V, was applied to the discharge roller 91. The results were desirable: charge was removed from the intermediary transfer belt 51 at the same time as positive charge was given to the post-secondary transfer residual toner on the intermediary transfer belt 51, without scattering the toner.

Embodiment 6

Since the rubber of the base layer 51*a* of the intermediary transfer belt 51 in this embodiment is extremely low in electrical resistance, the voltage on the inward facing surface of the intermediary transfer belt 51 remains virtually stable. Therefore, it is possible to apply DC voltage from a secondary transfer roller 71 and a discharge roller 91 simply by providing only a primary transfer roller 61 with voltage while keeping other rollers floated. Further, with the additional provision of the structure described in the third and fourth embodiments, desirable conditions for the application of the discharge AC voltage can be established.

As for the DC current which flows through the secondary transfer roller 71, the discharge roller 9, and the like, its level is greatly affected by the potential of the opposing rollers 72, 93, and the like, that is, the primary transfer voltage. Therefore, in order to flow stable DC current for the secondary transfer and the discharge, the voltage value of the primary transfer bias must be kept at a predetermined level while the secondary transfer process, the charge removal process, or the like, is carried out.

Figure 9:
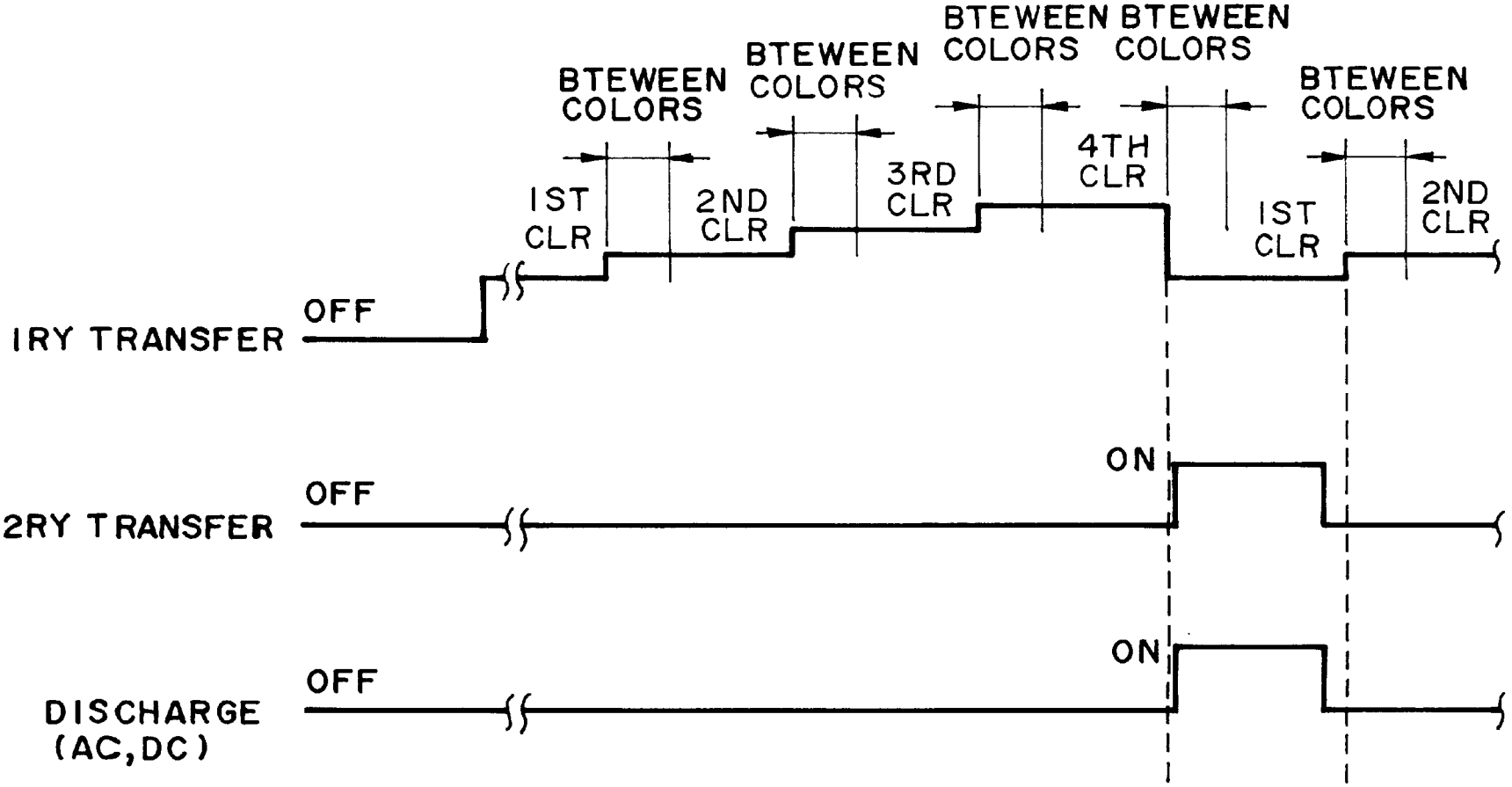
FIG. 9 shows timing of primary transfer, secondary transfer and discharging during a continuous printing operation.

FIG. 9 presents timing for continuous printing. First, yellow, magenta, cyan and black color toner images (first to fourth color images) are sequentially transferred onto the intermediary transfer belt 51 (primary transfer). Immediately after the completion of the primary transfer of the fourth color toner image, the primary transfer bias value is switched back to a value which is the same as the value of the primary transfer bias for the first color toner image. In other words, the value of the bias to be applied during the period between the completion of the primary transfer of the fourth color toner image for any given page, and the beginning of the primary transfer of the first color toner image for the following page, and the value of the bias to be applied for the primary transfer of the first color toner image for the following page, are rendered the same. With this arrangement, the value of the primary transfer bias can be prevented from fluctuating while the charge is removed from the intermediary transfer belt 51, and during a secondary transfer process, hence, the DC current values in the secondary transfer process, and the discharge, can be kept stable. In order to do so, it is necessary only to make the distance between the primary transfer nip $N_1$ and the secondary transfer nip $N_2$ measured in the rotational direction of the intermediary transfer belt 51 longer than the length of a printed image (length of a transfer medium P measured in the conveyance direction thereof).

Embodiment 7

In the preceding sixth embodiment, if the distance between the primary transfer nip $N_1$ and the secondary transfer nip $N_2$ is shorter than the length of an image to be printed, it is necessary either to render the primary transfer bias value for the first color toner image equal to that for the fourth color toner image, or to form the image for the following page after rotating the intermediary transfer belt 51 an extra distance after the completion of the primary transfer of the fourth color toner image. However, the former is impossible when an intermediary transfer belt coated with a high resistance layer is employed as in the present invention (proper primary transfer bias value for the first color toner image is in a range of +100–+200 V, whereas the proper primary transfer values for the second color toner image and thereafter, must be increased in stages; the proper primary transfer bias value for the fourth color toner image must be in a range of +600–+1000 V). On the other hand, the latter has a problem in that through-put declines in continuous printing.

Figure 10:
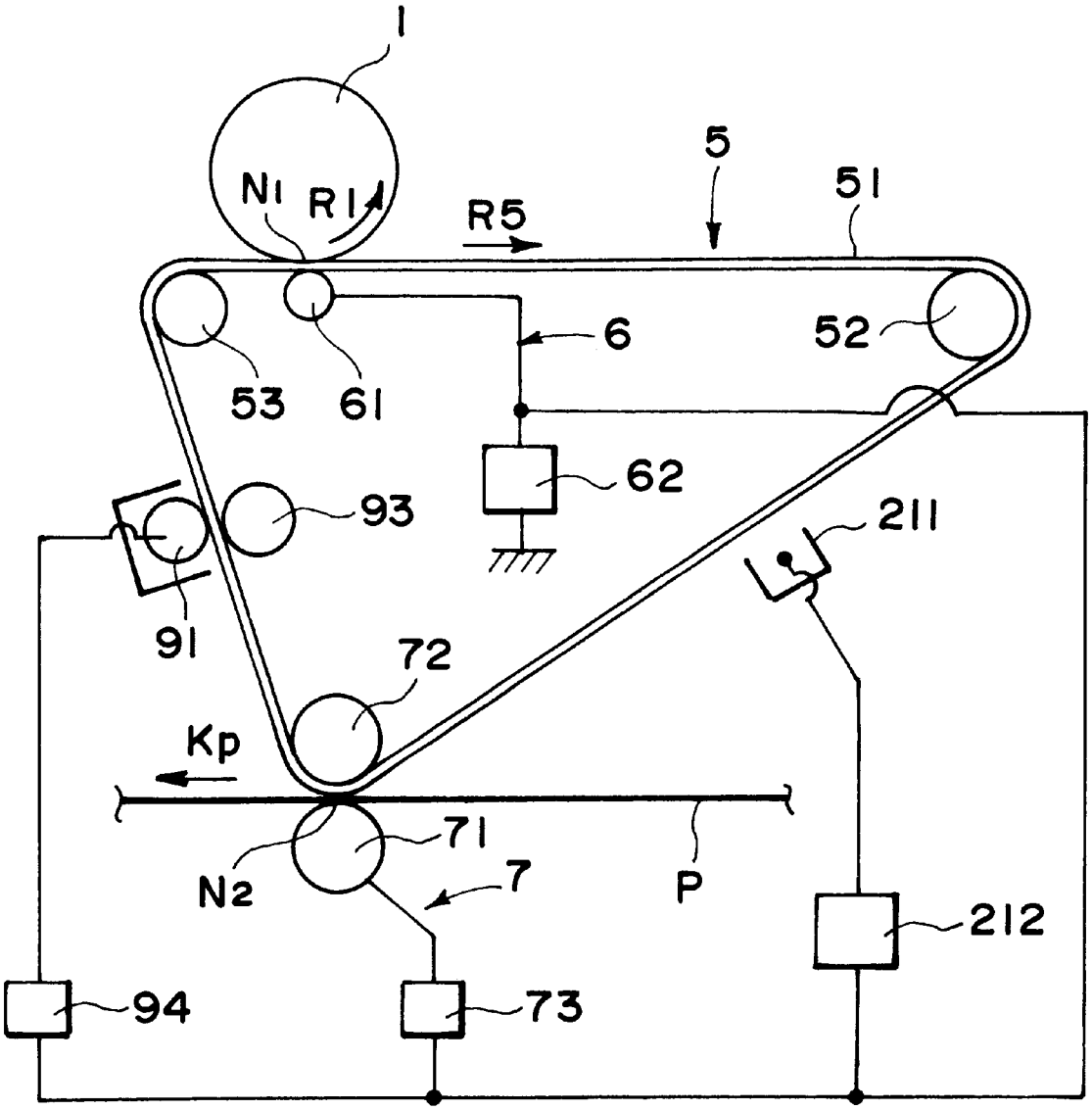
FIG. 10 is an illustration of a second image bearing member according to Embodiment 7 of the present invention.
Figure 11:
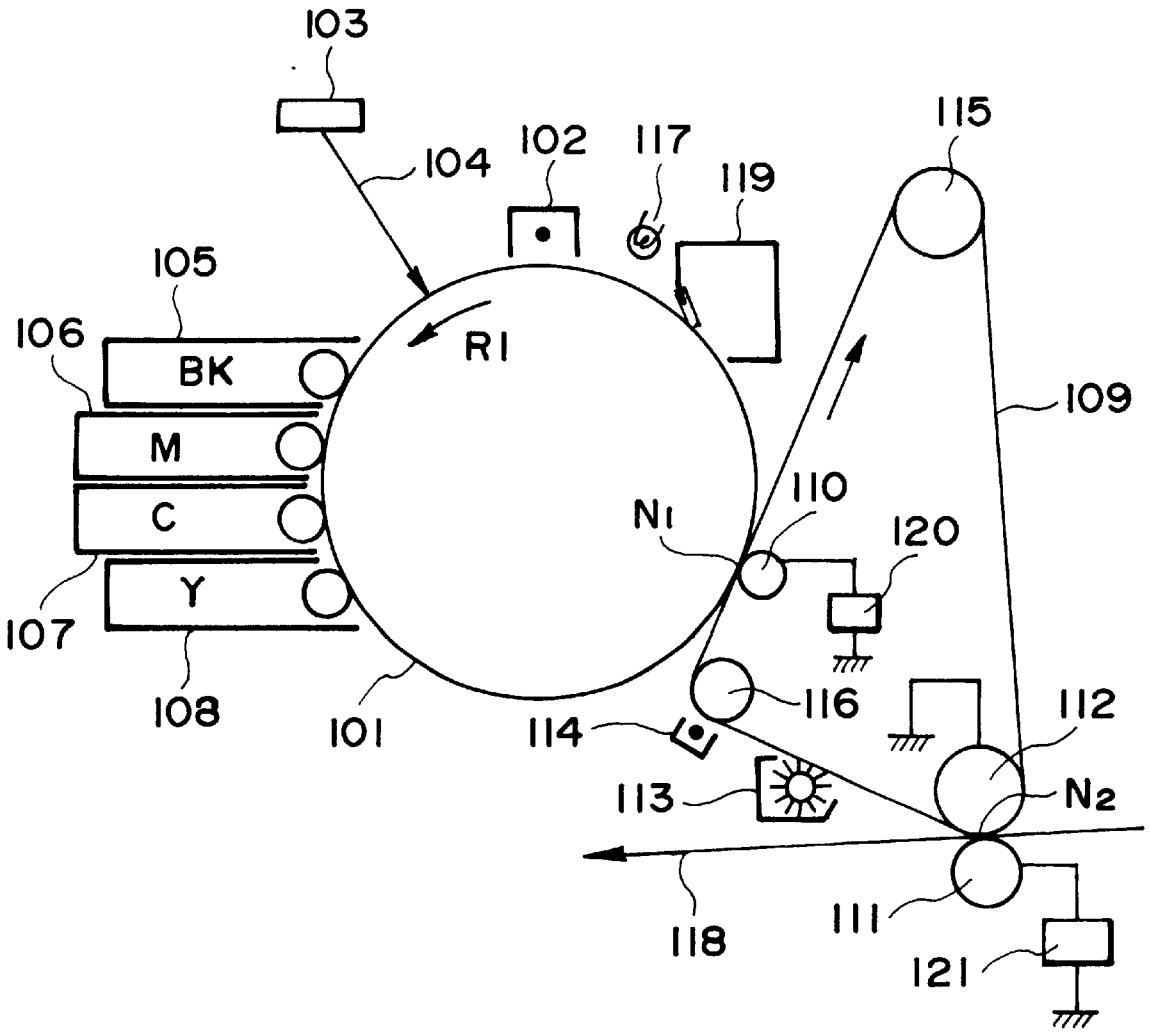
FIG. 11 is an illustration of a conventional image forming apparatus.

FIG. 10 depicts the seventh embodiment, according to which even if the primary transfer bias value fluctuates, the current is not affected during the secondary transfer and the discharge. In the drawing, in addition to a secondary transfer power source 73 and a discharge power source 94, an electrical power source 212 for a post charger (charging means) 211, and the like, are also connected to the output terminal of a primary transfer power source 62. In this case, the post charger 211 is used by applying, for example, an AC voltage having a peak-to-peak voltage Vpp of 8 kV, and a DC voltage of −500 V. It is disposed on the upstream side, for example, immediately before the secondary transfer point, to equalize the amount of the charge carried by the toner particles in the four color toner images formed on the intermediary transfer belt 51, so that the secondary transfer process can be carried out with better results. With the provision of the structure illustrated in FIG. 7, even if the distance between the primary transfer nip $N_1$ and the post charger 211 is shorter than the length of an image, the process carried out by the post charger is prevented from being affected by the fluctuation of the primary transfer bias (the same is true with the secondary transfer process, the discharge process, and the like). The seventh embodiment can be used in conjunction with the third embodiment or the like, with no problem.

As described above, according to the present invention, in order to prevent toner from scattering, during the image forming rotation of an intermediary transfer belt, from the full-color image regions composed of superposed toner images of primary color, an intermediary transfer belt is structured as described above, so that the charge attenuation time $\tau$ of the intermediary transfer belt can be adjusted to satisfy the following requirement:

$$T \leqq \tau \leqq 500 \text{ sec}$$

T: time necessary to rotate the intermediary transfer belt a full turn.

Therefore, very desirable full-color images which do not suffer from central transfer void can be produced.

Desirable efficiency can be realized for the secondary transfer even in the case of an image composed of a large amount of toner.

Also, according to the present invention, the low resistance base layer of an intermediary transfer belt is utilized as a counter electrode, and therefore, the intermediary transfer member can be easily discharged with the use of a simple contact type discharge roller; the structure can be simplified.

Further, the voltage for primary transfer is used as the reference potential for the post discharger as charging means disposed to face the intermediary transfer medium, the reference potential for a roller for secondary transfer, and the reference potential for a discharge roller, and the like. Therefore, images are not affected even if the voltage for primary transfer fluctuates. Further, such an arrangement is effective to reduce image formation time.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for carrying toner images of different colors;

a rotatable intermediary transfer member to which the toner images are superimposedly transferred from said image bearing member onto said intermediary transfer member at a first transfer position, wherein the toner images are then transferred all together from said intermediary transfer member onto the transfer material at a second transfer position;

wherein said intermediary transfer member includes an elastic layer having a thickness of 0.5–2 (mm), a coating layer, on said elastic layer, having a volume resistivity which is larger than that of said elastic layer, and said intermediary transfer member satisfies:

$$T \leqq \tau \leqq 500 \text{ (sec)}$$

where $\tau$ (sec) is time required for a potential V which is a potential of said intermediary transfer member at one second after start of charging of said intermediary transfer member to become V/e (e: base of natural logarithm, e=2.71828 . . . ); and T (sec) is a rotation period of said intermediary transfer member when the toner images on said image bearing member are sequentially and superimposedly transferred onto said intermediary transfer member at the first transfer position.

2. An apparatus according to claim 1, wherein the volume resistivity of said elastic layer is $10^2$–$10^7$ (Ω.cm).

3. An apparatus according to claim 1, wherein the thickness of said coating layer is 2–80 (μm).

4. An apparatus according to claim 1, further comprising discharging means for electrically discharging said intermediary transfer member, said discharging means being movable toward and away from to a side of said intermediary transfer member on which the toner image is carried, wherein said discharging means is brought into contact with said intermediary transfer member to discharge said intermediary transfer member after the toner images are transferred all together from said intermediary transfer member onto the transfer material at the second transfer position.

5. An apparatus according to claim 4, further comprising developing means for developing electrostatic images on said image bearing member into the toner images, wherein said discharging means charges residual toner remaining on said intermediary transfer member after the toner images are transferred all together from said intermediary transfer member onto the transfer material at the second transfer position, to a polarity opposite from a regular charging polarity of the toner in said developing means, and the residual toner on said intermediary transfer member is transferred back onto said image bearing member at the first transfer position.

6. An apparatus according to claim 5, wherein a next toner image is transferred from said image bearing member onto the intermediary transfer member substantially simultaneously with the back-transfer of the residual toner from said image bearing member onto said intermediary transfer member at said first transfer position.

7. An apparatus according to claim 1, wherein said intermediary transfer member is in the form of a belt.

8. An image forming apparatus comprising:

an image bearing member for carrying toner images of different colors;

a rotatable intermediary transfer member to which the toner images are superimposedly transferred from said image bearing member onto said intermediary transfer member at a first transfer position, wherein the toner images are then transferred all together from said intermediary transfer member onto the transfer material at a second transfer position;

wherein said intermediary transfer member includes an elastic layer having a thickness of 0.5–2 (mm), a coating layer, on said elastic layer, having a volume resistivity which is larger than that of said elastic layer, and said intermediary transfer member satisfies:

$$T \leqq \tau(\text{sec})$$

where $\tau$ (sec) is time required for a potential V which is a potential of said intermediary transfer member at one second after start of charging of said intermediary transfer member to become V/e (e: base of natural logarithm, e=2.71828 . . . ); and T (sec) is a rotation period of said intermediary transfer member when the toner images on said image bearing member are sequentially and superimposedly transferred onto said intermediary transfer member at the first transfer position; and the following is satisfied:

$$1.005 \leqq V_2/V_1 \leqq 1.02, \text{ and}$$

$$0.985 \leqq V_2/V_1 \leqq 0.995$$

where $V_1$ is a surface speed of said intermediary transfer member at the second transfer position, and $V_2$ is a surface speed of the transfer material when it passes through the second transfer position.

9. An apparatus according to claim 8, wherein the volume resistivity of said elastic layer is $10^2 10^{-7}$ (Ω.cm).

10. An apparatus according to claim 8, wherein the thickness of said coating layer is 2–80 (μm).

11. An apparatus according to claim 8, further comprising discharging means for electrically discharging said intermediary transfer member, said discharging means being movable toward and away from to a side of said intermediary transfer member on which the toner image is carried, wherein said discharging means is brought into contact with said intermediary transfer member to discharge said intermediary transfer member after the toner images are transferred all together from said intermediary transfer member onto the transfer material at the second transfer position.

12. An apparatus according to claim 11, further comprising developing means for developing electrostatic images on said image bearing member into the toner images, wherein said discharging means charges residual toner remaining on said intermediary transfer member after the toner images are transferred all together from said intermediary transfer member onto the transfer material at the second transfer position, to a polarity opposite from a regular charging polarity of the toner in said developing means, and the residual toner on said intermediary transfer member is transferred back onto said image bearing member at the first transfer position.

13. An apparatus according to claim 12, wherein a next toner image is transferred from said image bearing member onto the intermediary transfer member substantially simultaneously with the back-transfer of the residual toner from said image bearing member onto said intermediary transfer member at said first transfer position.

14. An apparatus according to claim 8, wherein said intermediary transfer member is in the form of a belt.

* * * * *

UNITED STATES PATENT AND TRADEMARK OFFICE

CERTIFICATE OF CORRECTION

PATENT NO. : 5,946,538

DATED : August 31, 1999

INVENTOR(S) : Akihiko Takeuchi, et al.

It is certified that error appears in the above-identified patent and that said Letters Patent is hereby corrected as shown below:

COVER PAGE:

Please insert:

--[*] Notice: This patent issued on a continued prosecution application filed under 37 CFR 1.53(d), and is subject to the twenty year patent term provisions of 35 U.S.C. 154(a)(2).--

DRAWINGS:

Sheet 7, Figure 9, "BTEWEEN" (all occurrences) should read --BETWEEN--.

Sheet 10, Figure 13, "THICHNSS" should read --THICKNESS--.

COLUMN 1:

Line 25, "yellow (M)" should read --yellow (Y)--.

UNITED STATES PATENT AND TRADEMARK OFFICE

CERTIFICATE OF CORRECTION

PATENT NO. : 5,946,538

DATED : August 31, 1999

INVENTOR(S) : Akihiko Takeuchi, et al.

It is certified that error appears in the above-identified patent and that said Letters Patent is hereby corrected as shown below:

COLUMN 16:

Line 26, "through-put" should read --throughput--.

Signed and Sealed this

Twenty-third Day of May, 2000

*Attest:*

Q. TODD DICKINSON

*Attesting Officer*

*Director of Patents and Trademarks*